US005842925A

United States Patent [19]

Ellroy et al.

[11] Patent Number: 5,842,925

[45] Date of Patent: Dec. 1, 1998

[54] APPARATUS FOR PRODUCING AND VIEWING RAINBOWS

[76] Inventors: Mary Doherty Ellroy, 393 Rowayton Ave., Norwalk, Conn. 06854; Frank A. Posluszny, 23 Kent Pl., Cos Cob, Conn. 06807

[21] Appl. No.: 984,430

[22] Filed: Dec. 3, 1997

Related U.S. Application Data

[60] Provisional application No. 60/031,570 Dec. 4, 1996.

[51] Int. Cl.[6] ..... A63J 5/02

[52] U.S. Cl. ..... 472/65; 40/407

[58] Field of Search ..... 472/65, 66, 128, 472/57; 434/300, 283; 40/406, 407–427

[56] References Cited

U.S. PATENT DOCUMENTS 2,715,529 8/1955 Ajello et al. ..... 472/65
4,002,333 1/1977 Gotoh ..... 472/65
4,028,830 6/1977 Ottinger ..... 472/65 X
4,743,477 5/1988 Beaver ..... 472/65 X

*Primary Examiner*—Kien T. Nguyen
*Attorney, Agent, or Firm*—Raymond A. Nuzzo

[57] ABSTRACT

An apparatus for producing and viewing rainbows comprising a base portion, a body portion wherein the body portion is attached to the base, has a front side, a rear side and is generally vertically oriented with respect to the base portion. The apparatus further includes a fluid channel supported by the body portion. The fluid channel has a fluid inlet fluidly connected to a fluid source and a fluid outlet for producing a spray mist above the apparatus. The apparatus further comprises an element for optimally aligning the apparatus relative to the sun. The apparatus is optimally aligned when the front side of the body portion is substantially directly facing the sun. The user of the apparatus is able to view a rainbow created as a result of the sunlight being refracted by the spray mist emanating from the fluid outlet when the user is facing the front side of the body portion and the sun is at the user's back.

27 Claims, 9 Drawing Sheets

APPARATUS FOR PRODUCING AND VIEWING RAINBOWS

This application claims the benefit of the filing date of commonly owned and copending U.S. Provisional Application Serial No. 60/031,570 filed Dec. 4, 1996.

BACKGROUND OF THE INVENTION

COPYRIGHT NOTICE

© Copyright 1997, Mary D. Ellroy and Frank A. Posluszny. All rights reserved.

A portion of the disclosure of this patent document contains material that is subject to copyright protection. The copyright owners have no objection to the facsimile reproduction by anyone of the patent document or the patent disclosure, as it appears in the USPTO patent file or records, but otherwise reserves all copyright rights whatsoever.

1. Field of the Invention

The present invention generally relates to an apparatus for producing rainbows.

2. Background

A rainbow is an arc showing the colors of the color spectrum and appears when sunlight shines through water droplets. Rainbows often appear during or after a rain shower. People, especially children, have always been fascinated with rainbows and their inherent beauty. Over time, rainbows have come to symbolize happiness, success, hope and love. Rainbows have been the subject of many songs, paintings, illustrations and movies. It can be said that rainbows have a positive impact on the human psyche.

What is needed is an apparatus that can produce a relatively small-scale rainbow without dependence upon particular atmosphere conditions. One desirable feature of such an apparatus is that it should be simple to use. Another desirable feature is that it should be safe to operate so that children may use the apparatus. A further desirable feature of such an apparatus is that it should be inexpensive to manufacture.

Therefore, it is an object of the present invention to provide an apparatus for producing rainbows.

It is another object of the present invention to provide an apparatus for producing rainbows that is safe to operate.

It is a further object of the present invention to provide an apparatus for producing rainbows that is easy to operate.

It is yet a further object of the present invention to provide a method for viewing a rainbow.

It is another object of the present invention to provide an apparatus for producing rainbows that is inexpensive to manufacture.

Other objects and advantages of the present invention will be apparent to one of ordinary skill in the art in light of the ensuing description of the present invention.

SUMMARY OF THE INVENTION

The above and other objects, which will be apparent to those skilled in the art, are achieved in the present invention which is directed to, in a first aspect, to an apparatus for producing and viewing rainbows comprising a body portion having a front side, a rear side and being generally vertically oriented. The apparatus further includes a fluid channel supported by the body portion. The fluid channel has a fluid inlet fluidly connected to a fluid source and a fluid outlet for producing a spray mist above the apparatus. The apparatus further comprises means for optimally aligning the apparatus relative to the sun. The apparatus is optimally aligned when the front side of the body portion is substantially directly facing the sun. The user of the apparatus is able to view a rainbow created as a result of the sunlight being refracted by the spray mist emanating from the fluid outlet when the user is facing the front side of the body portion and the sun is at the user's back.

BRIEF DESCRIPTION OF THE DRAWINGS

The features of the invention are believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DETAILED DESCRIPTION OF THE INVENTION

In describing the preferred embodiments of the present invention, reference will be made herein to FIGS. 1–19 of the drawings in which like numerals refer to like features of the invention.

Figure 1:
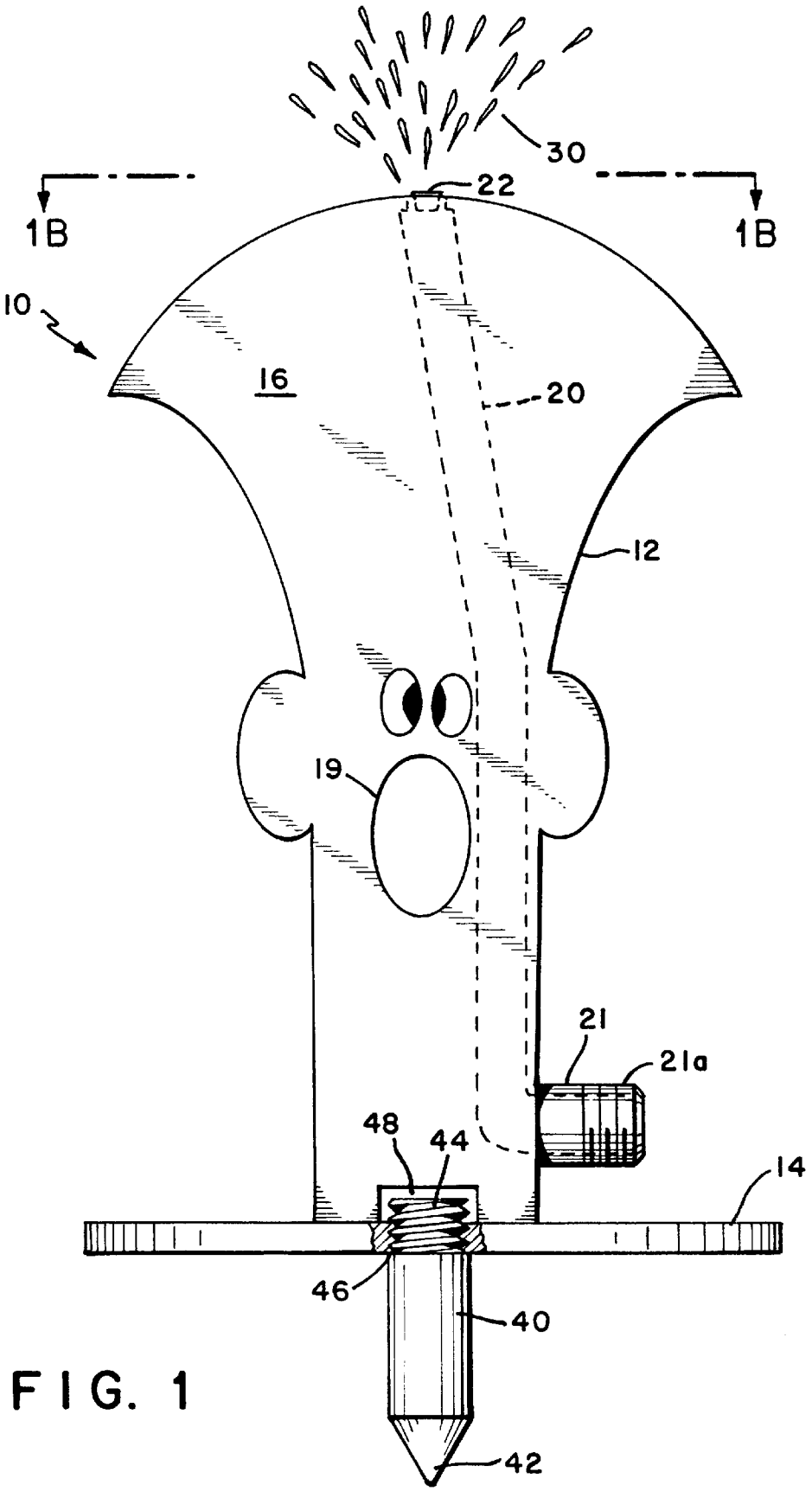
FIG. 1 is a front-elevational view of the rainbow producing apparatus of the present invention.

Referring to FIG. 1, rainbow producing apparatus 10 of the present invention generally comprises body 12 and base 14. Body 12 is attached to base 14. Body 12 may be attached or fastened to base 14 using any one of a number of well known techniques. The actual fastening technique depends upon the materials from which body 12 and base 14 are fabricated. In an alternate embodiment, body 12 and base 14 may be integrally formed as one piece. Body 12 is substantially vertically positioned with respect to base 14. In a preferred embodiment, body 12 is substantially perpendicular to base 14. In a preferred embodiment, base 14 has a substantially circular shape. However, base 14 may be configured to have any one of a variety of geometrical shapes, e.g. square, rectangular, triangular, etc.

Figure 3:
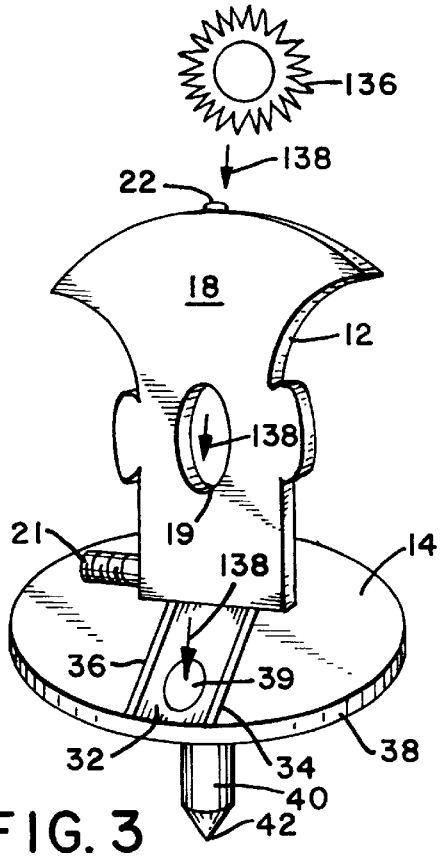
Figure 4:
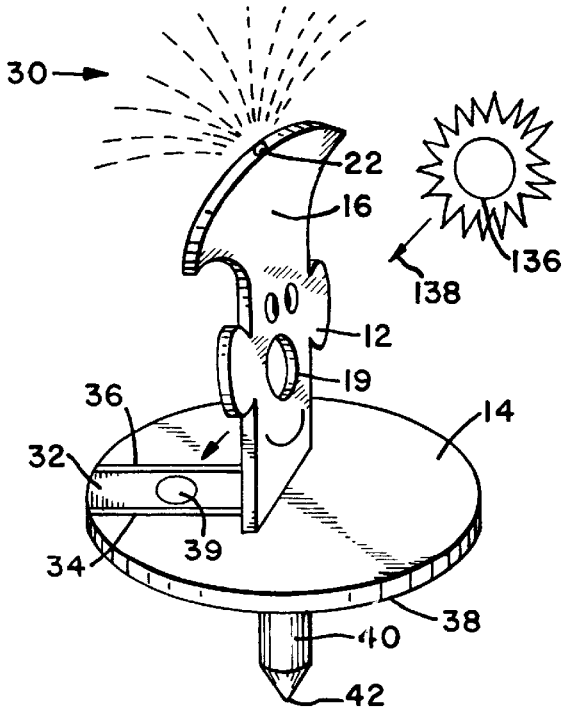
Figure 5:
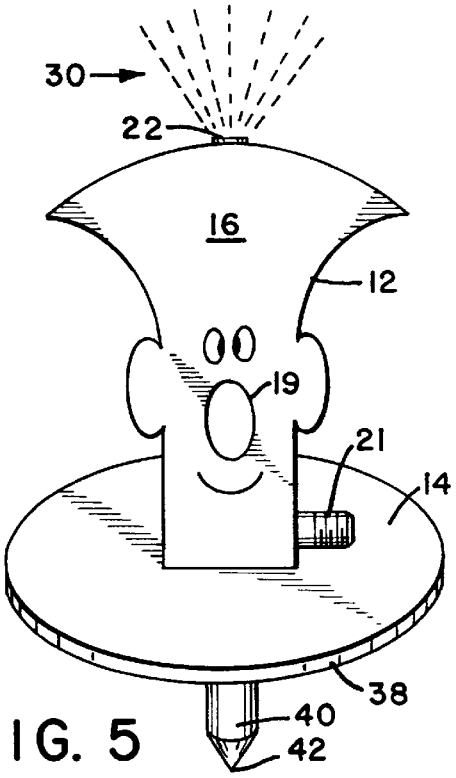

Referring to FIGS. 1 and 3, body 12 has a front side 16 and rear side 18. Identifying indicia is placed either on front side 16 or rear side 18, or both sides 16 and 18, to facilitate identification of each of the sides. Body 12 may be configured to have a decorative shape. In a preferred embodiment, body 12 is substantially planar. Body 12 can be fabricated in one of many ways. For example, in one embodiment, body 12 is a single piece having front and rear sides 16 and 18, respectfully. In another embodiment, front and rear sides 16 and 18, respectfully, are separate pieces that are attached together. The technique for attaching front side 16 to rear side 18 depends upon the materials used to fabricate body 12. For example, if body 12 is fabricated from stainless steel, front side 16 and rear side 18 can be attached together by screws, welding, rivets, etc. Similarly, if front side 16 and rear side 18 are fabricated from wood, then adhesives, screws, nails, etc. can be used. If body 12 and base 14 are fabricated from plastic, then the edges of front and rear sides 16 and 18, respectfully, can be sonically welded. Body 12 and base 14 can be fabricated from other materials as well, e.g. rubber, PVC (polyvinylchloride). In a preferred embodiment, body 12 and base 14 are fabricated from corrosion-resistant materials.

Referring again to FIG. 1, body 12 further includes opening 19. Opening 19 allows for the passage of sunlight therethrough. This purpose of the function of opening 19 will be explained below in detail. In an alternate embodiment, a transparent or translucent member is positioned within opening 19 to function as a window. In one embodiment, the transparent or translucent member may be rigidly positioned within opening 19. The transparent or translucent member may be tinted or colored. The purpose of a colored or tinted transparent or translucent member will be discussed below. The transparent or translucent member may be fabricated from glass, film, plastic, Plexiglas, etc.

Referring to FIG. 1, body 12 further includes internal fluid channel 20 for carrying or transporting fluids. Channel 20 extends for substantially the entire height of body 12. Channel 20 is fluidly connected to fluid inlet 21 and fluid outlet 22. In one embodiment, fluid channel 20 may be integrally formed within body 12. For example, body 12 can be formed as a single piece with a bore or internal channel formed therein that extends the entire length or height of body 12. In another example, body 12 is configured in a manner such that front and rear sides 16 and 18, respectfully, are separate pieces wherein either front side 16 or rear side 18 has a channel formed therein. When the other side of body 12 (which does not have a channel) is attached to the side of body 12 that has the channel, internal fluid channel 20 is formed. In a further example, body 12 can be also be configured in a manner such that front side 16 and rear side 18 are separate pieces wherein each side has a channel half formed in one side which aligns with the channel half of the other side. Thus, when the front and rear sides are attached to one another, the channel halves form a complete internal fluid channel. In another embodiment, internal fluid channel 20 is configured as a separate conduit or tube that is disposed within a channel or bore formed in body 12. In a further embodiment, front and rear sides 16 and 18, respectively, are separate pieces attached together and fluid channel 20 is configured as a conduit or tube disposed between front and rear sides 16 and 18, respectively. In yet another embodiment, fluid channel 20 is configured as fluid conduit or tube attached to the rear side of the body of the rainbow producing apparatus. Such an embodiment is shown as rainbow producing apparatus 10' in FIG. 1A. Apparatus 10' comprises body 12'and base 14'. Body 12' has front side 16', rear side 18' and opening 19'. Opening 19' functions in a manner identical to opening 19 shown in FIG. 1. Apparatus 10' further includes fluid conduit 20' attached to rear side 18'. Clamp 23 secures fluid conduit 20' to rear side 18'. Apparatus 10' further includes fluid inlet 21' adapted for fluid-tight connection to a fluid supplying conduit, and fluid outlet 22'.

Referring to FIG. 1, fluid inlet 21 is integral with fluid channel 20 and has end 21 a that is adapted to be fluidly connected to a fluid supplying conduit (not shown). In a preferred embodiment, end 21*a* is threaded. If a conduit a tube is used to form fluid channel 20, and the conduit is either disposed within a bore in body 12, as discussed above, or attached to rear side 18, as discussed above, then fluid inlet 21 can either be integral with the conduit, as discussed above, or configured as a separate coupling fluidly connected to the conduit. If fluid inlet 21 is configured as a separate coupling, then it is preferred if such coupling is configured as coupling 24 shown in FIG. 9. Coupling 24 is a right-angle or "elbow-type" coupling and comprises portions 24*a* and 24*b*. Portion 24*a* includes barbs 25 to provide a fluid-tight connection between portion 24*a* and the conduit forming channel 20. Portion 24*b* includes threads 26 for threaded engagement with a fluid-supplying conduit (not shown), e.g. hose, pipe, etc. Although coupling 24 has been described above as being a right-angle or "elbow-type" coupling, it is to be understood that other type couplings may be used.

Referring to FIG. 1, fluid outlet 22 comprises a nozzle. In a preferred embodiment, fluid outlet 22 is configured as nozzle 28 shown in FIG. 8. Nozzle 28 includes barbs 29 for providing a fluid-tight connection with fluid channel 20. Nozzle 28 is configured to produce mist or spray 30. In a preferred embodiment, nozzle 28 is configured to produce mist or spray 30 having a "fan" shape or a substantially V-shape (see FIGS. 1, 4 and 5). However, nozzles producing mists having different shapes can also be used. It is to be understood that nozzle 28 is only one way of producing mist or spray 30. Fluid outlet 22 may be configured in other ways to produce spray or mist 30. For example, in an alternate embodiment, fluid outlet 22 may be configured to have a plurality of apertures to produce spray or mist 30. In another embodiment, fluid outlet 30 is fluidly connected to a shower head to produce spray or mist 30. As will be shown below, mist 30 functions as a light refracting medium.

Referring to FIGS. 1B, 2, 3, 4, and 5, rainbow producing apparatus 10 further comprises sunspot alignment region 32 which may or may not be located on base 14. Sunspot alignment region 32 comprises stripes 34 and 36 of graphic material or indicia and the portion of the surface area of base 14 that is between stripes 34 and 36. In a preferred embodiment, stripes 34 and 36 extend from the location where body 12 joins base 14 to perimetrical edge 38 of base 14 (see FIG. 3). In a preferred embodiment, stripes 34 and 36 are substantially straight. However, alignment region 32 may be configured with different shape graphics or indicia. For example, in one embodiment, a single stripe of graphic material or indicia may be used instead of separate stripes 34 and 36 as described above. In another embodiment, a single, wide stripe may be used. Referring to FIGS. 1, 1B, 2, 3, 4 and 5, the position of opening 19 in body 12 and the position of sunspot alignment region 32 relative to opening 19 are such that when front side 16 of body 12 is directly facing the sun, sunlight passes through opening 19 and forms sunspot 39 within sunspot alignment region 32. Specifically, sunspot 39 appears between stripes 34 and 36. This will be discussed in detail below.

Figure 6:
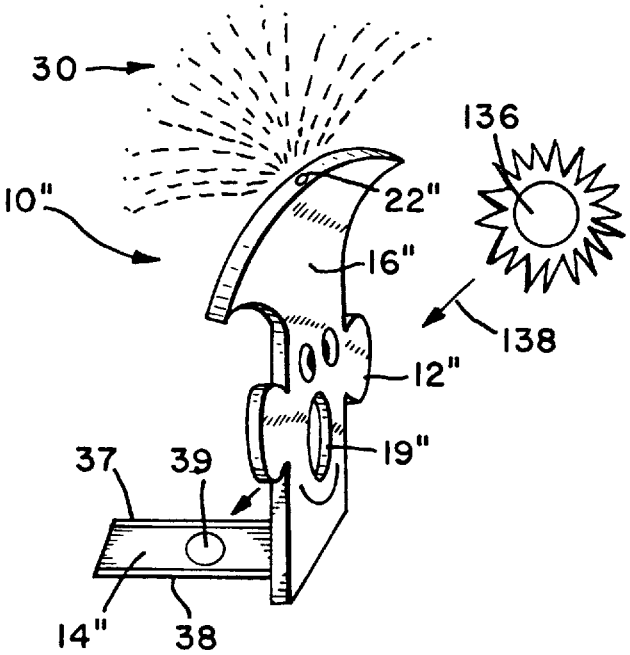
FIG. 6 is a perspective view of an alternate embodiment of the rainbow producing apparatus of the present invention.
Figure 8:
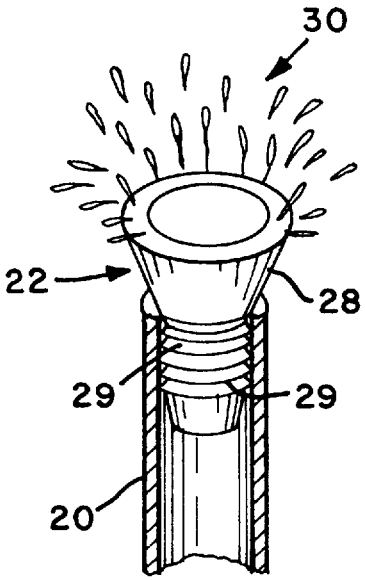
FIG. 8 is a perspective view, partially in cross-section, of a preferred nozzle configuration for use with the rainbow producing apparatus of the present invention.
Figure 2:
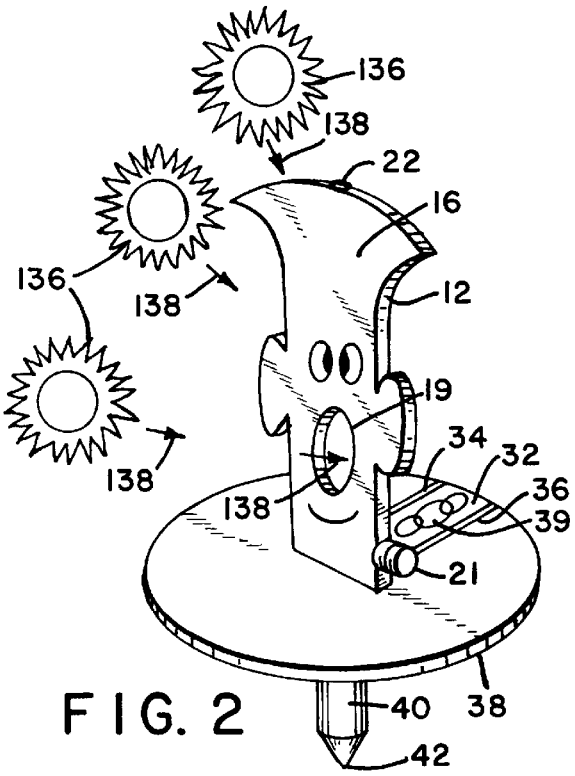
FIGS. 2–5 are perspective views of the rainbow producing apparatus of FIG. 1.

Referring to FIG. 6, in an alternate embodiment, base 14 is not utilized and base 14" may be comprised entirely of sunspot alignment region 32. Apparatus 10" comprises body 12" and base 14". Body 12" includes front side 16", a rear side (not shown) and defines opening 19". Body 12" includes an internal fluid channel (not shown) that is similar to fluid channel 20 discussed above and which is fluidly connected to fluid outlet 22". Body 12" further includes a fluid inlet (not shown) that is similar to fluid inlet 21 discussed above. Base 14" has ends 37 and 38 and function in the same manner as stripes 34 and 36, respectively, described above. Thus, base 14" and ends 37 and 38 cooperate to function in substantially the same manner as sunspot alignment region 32. This will be described in detail below.

Figure 1A:
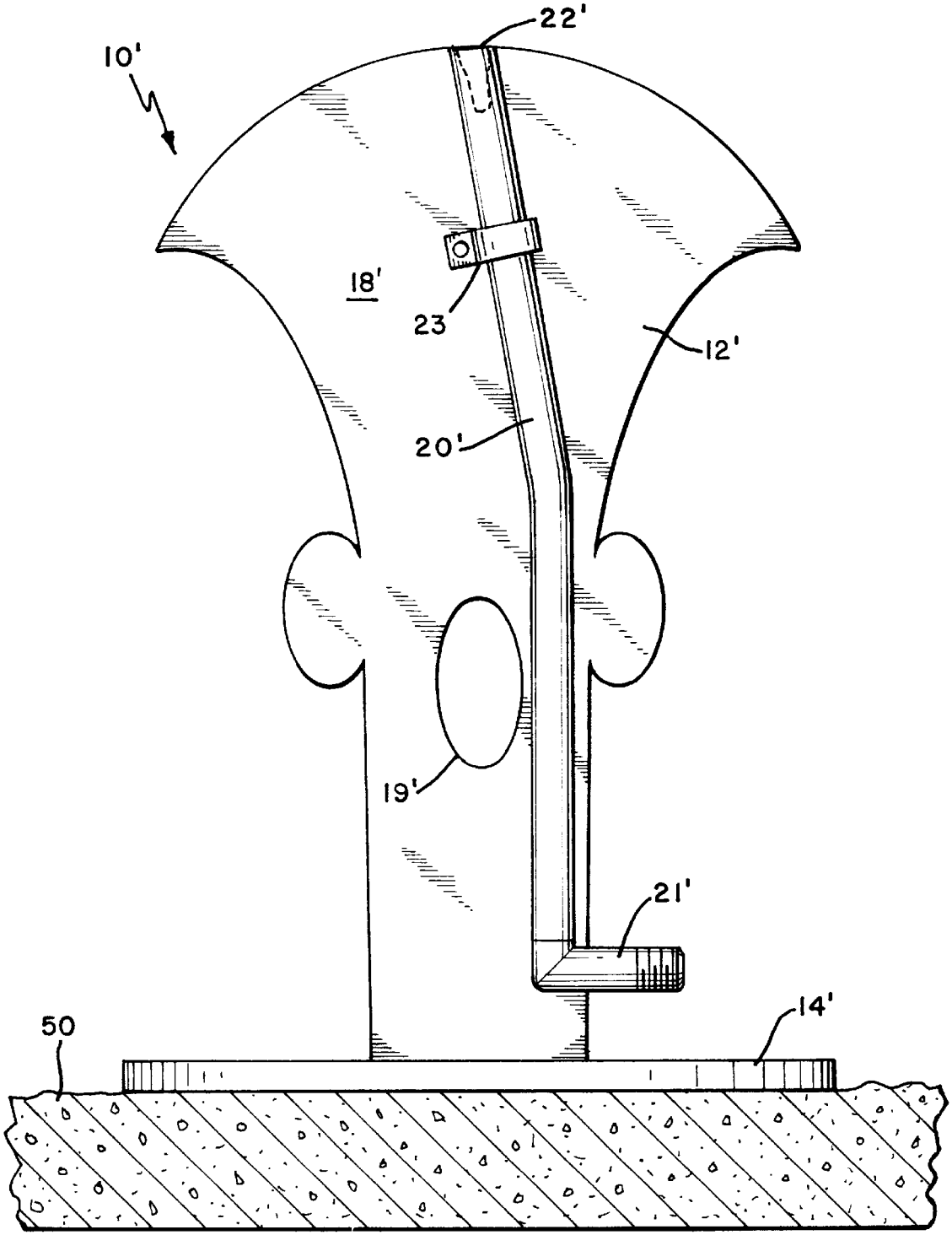
FIG. 1A is a rear-elevational view of an alternate embodiment of the rainbow producing apparatus of FIG. 1.
Figure 1B:
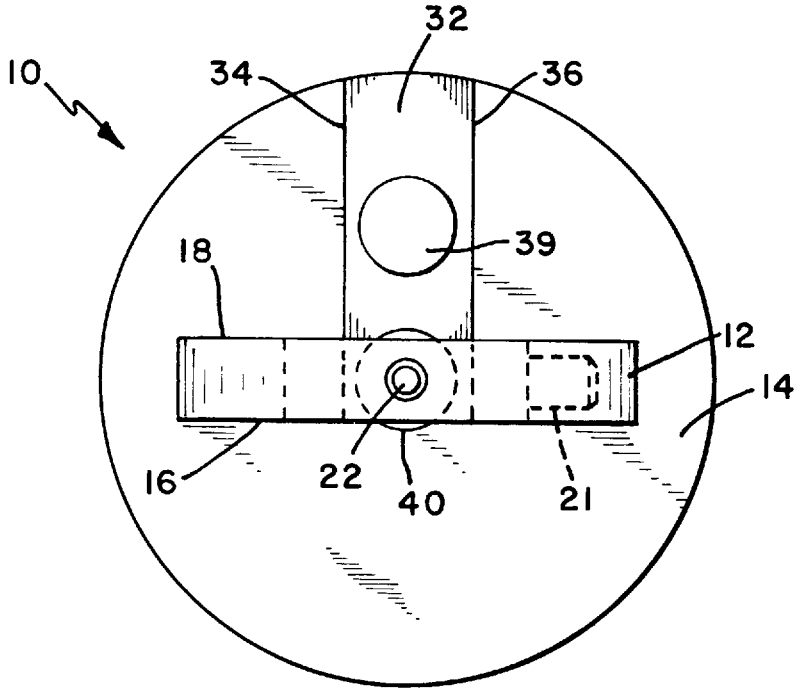
FIG. 1B is a top plan view taken along line 1B—1B of FIG. 1.

Referring to FIG. 1, rainbow producing apparatus 10 further includes elongate member 40 attached to base 14. Elongate member 40 is adapted for insertion into the soil or ground in order to secure or stabilize rainbow producing apparatus 10. Elongate member 40 includes ends 42 and 44. End 42 is tapered to facilitate insertion of member 40 into the soil. End 44 is removably attached to base 14. Base 14 has opening 46 for receiving end 44 of elongate member 40. Body 12 has notch 48 for receiving end 44 of elongate member. In a preferred embodiment, end 44 and opening 46 are threaded and end 44 is threadedly engaged with the threads of opening 46. In an alternate embodiment, end 44 and opening 46 are not threaded and end 44 is removably and frictionally disposed within opening 46. Elongate member 40 has a substantially circular cross-section to allow the user to rotate rainbow producing apparatus 10 while member 40 is inserted into the soil. Elongate member 40 may be fabricated from a variety of materials, e.g. plastic, copper, brass, stainless steel, aluminum, etc. In a preferred embodiment, elongate member 40 is fabricated from materials that are corrosion resistant and which can withstand relatively high fluid pressure. In a further embodiment, rainbow producing apparatus 10 does not utilize elongate member 40. In such an embodiment, apparatus 10 is placed directly on the ground such that base 14 contacts and rests upon the ground as shown in FIG. 1A.

Figure 7:
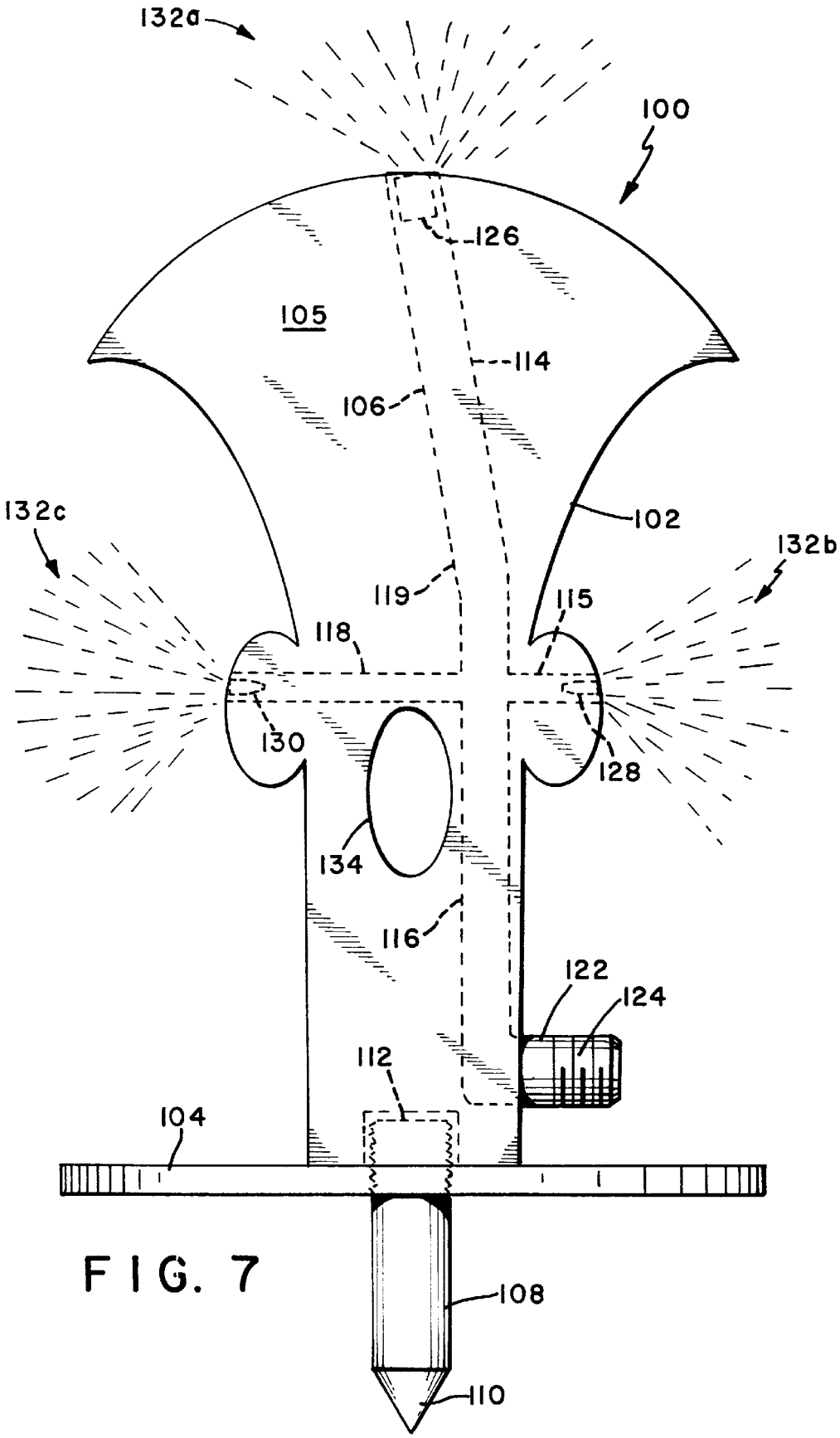
FIG. 7 is front elevational view of a further embodiment of the rainbow producing apparatus of the present invention.
Figure 9:
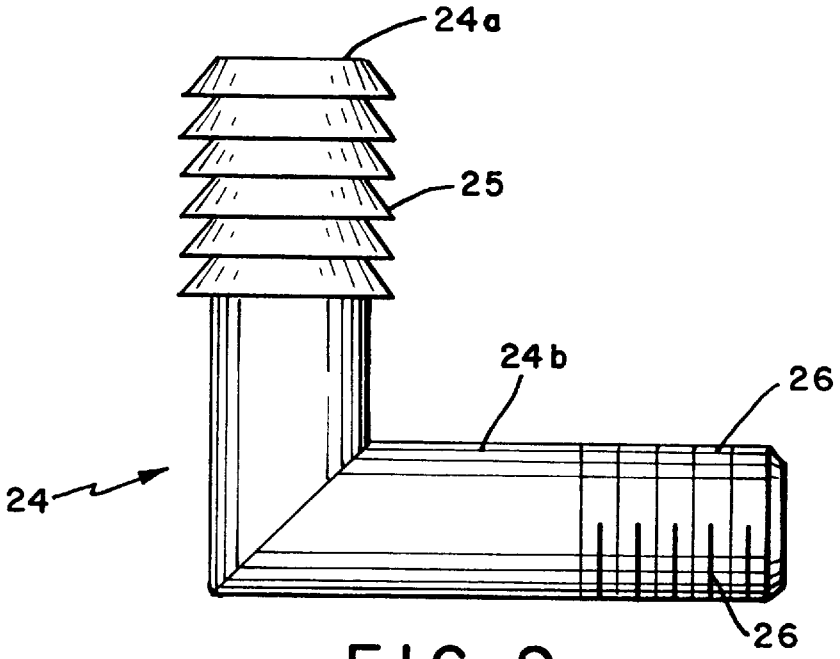
FIG. 9 is an elevational view of a fluid coupling depicted in FIG. 1A.
Figure 10:
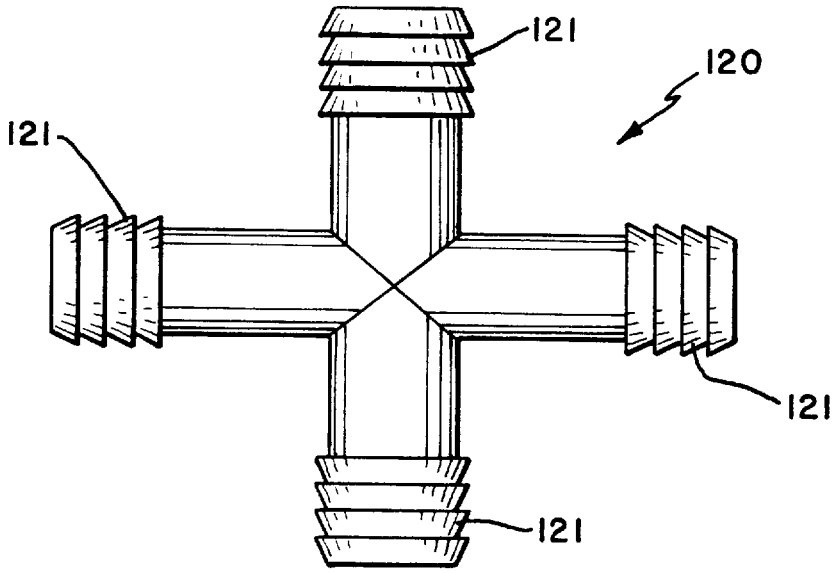
FIG. 10 is an elevational view of a preferred four-way fluid coupling for use with an alternate embodiment of the present invention.

Referring to FIG. 7, an alternate embodiment of the present invention is shown. Rainbow producing apparatus 100 generally comprises body 102 and base 104. Body 102 is attached to base 104. Similar to body 12 and base 14 discussed above, the manner in which body 102 is attached to base 104 depends upon the materials from which body 102 and 104 are fabricated. Body 102 and base 104 may also be integrally formed as one piece. Body 102 is substantially vertically positioned with respect to base 104. In a preferred embodiment, body 102 is substantially perpendicular to base 104. Body 102 has front side 105 and a rear side (not shown). Identifying indicia is placed either on the front side or rear side, or both sides, to facilitate identification of each of the sides. Body 102 may be configured to have a decorative shape. In a preferred embodiment, body 102 is substantially planar. Base 104 may be configured to have any one of a variety of geometrical shapes. In a preferred embodiment, base 104 has a substantially circular shape. Referring to FIG. 7, body 102 and base 104 may be fabricated from a variety of materials, e.g. plastic, wood, stainless steel, rubber, PVC (polyvinylchloride), etc. In a preferred embodiment, body 102 and base 104 are fabricated from corrosion-resistant materials.

Referring to FIG. 7, rainbow producing apparatus 100 also includes elongate member 108 which functions in the same manner as elongate member 40 discussed above. Elongate member 108 includes end 110. End 110 is tapered to facilitate insertion of member 108 into the soil. Elongate member 108 further includes threaded end 112 for threaded engagement with threaded inlet 114 of base 104. In an alternate embodiment, rainbow producing apparatus 100 is configured without elongate member 108. When apparatus 100 is configured without elongate member 108, base 104 directly contacts the ground or floor. In a further embodiment, apparatus 100 is configured without elongate member 108 and base 104 is hollow and is filled with water so as to act as a weight or anchor. Such a configuration is useful when soft soil or ground is not available for insertion of elongate member 108.

Referring to FIG. 7, body 102 includes fluid channel 106 which comprises fluid channel sections 114, 115, 116 and 118. Fluid channel 106 may be formed in manner similar to fluid channel 20 discussed above. For example, in one embodiment, fluid channel 106 may be integrally formed within body 102. In another embodiment, fluid channel 106 is configured as a conduit or tube disposed within a bore formed in body 102. In a further embodiment, front side 105 and the rear side are separate pieces and fluid channel 105 is configured as a conduit or tube disposed between front side 105 and the rear side. If fluid channel 106 is configured as a conduit having separate fluid conduit or tube sections 114, 115, 116 and 118, then a four-way coupling is preferably used to fluidly connect fluid channel sections 114, 115, 116 and 118 together. Such a four-way coupling may be configured as coupling 120 shown in FIG. 10. Coupling 120 includes barbs 121 to facilitate fluid-tight connection between coupling 120 and conduit sections 114, 115, 116 and 118. In yet a further embodiment, fluid channel 106 is configured as a conduit or tube having sections 114, 115, 116 and 118 and is attached to the rear side of body 102 similar to the way conduit 20' is attached to rear side 18' as shown in FIG.1A.

Referring to FIG. 7, fluid channel 106 further includes fluid inlet 122. In one embodiment, fluid inlet 122 is integral with fluid channel section 116 and has threads 124 formed thereon for threaded engagement with a fluid supplying conduit, e.g. hose, pipe, tube, etc. In an alternate embodiment, fluid inlet 122 is configured as a separate coupling that is constructed substantially identical to coupling 24 shown in FIG. 9. Body 102 further includes fluid outlets 126, 128 and 130. Outlets 126, 128 and 130 are fluidly connected to fluid channel sections 114, 115 and 118, respectively. In a preferred embodiment, each fluid outlet 126, 128 and 130 comprises a nozzle configured as nozzle 28 shown in FIG. 8. Each nozzle produces a respective mist 132*a*, 132*b* and 132*c* as shown see FIG. 7. Although apparatus 100 is discussed above as having three fluid outlets, it is to be understood that more apparatus 100 may be configured to have more than three fluid outlets.

Body 104 further includes opening 134 which functions in the same manner as opening 30 in body 12 which has been described above. Rainbow producing apparatus 100 further includes a sunspot alignment region (not shown) located on base 104 which is substantially identical to and functions in the same manner as sunspot alignment region 32 described above. In an alternate embodiment, a transparent or translucent member is positioned within opening 134 to function as a window. The transparent or translucent member may also be tinted or colored. The purpose of a colored or tinted transparent or translucent member will be discussed below.

Figure 12:
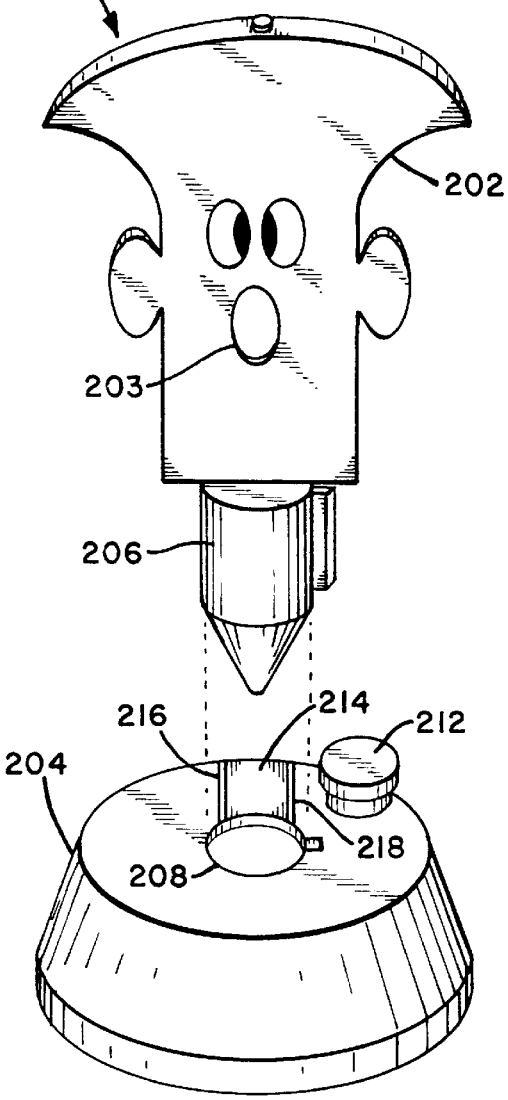
FIG. 12 is a perspective view of an alternate embodiment of the present invention.
Figure 13:
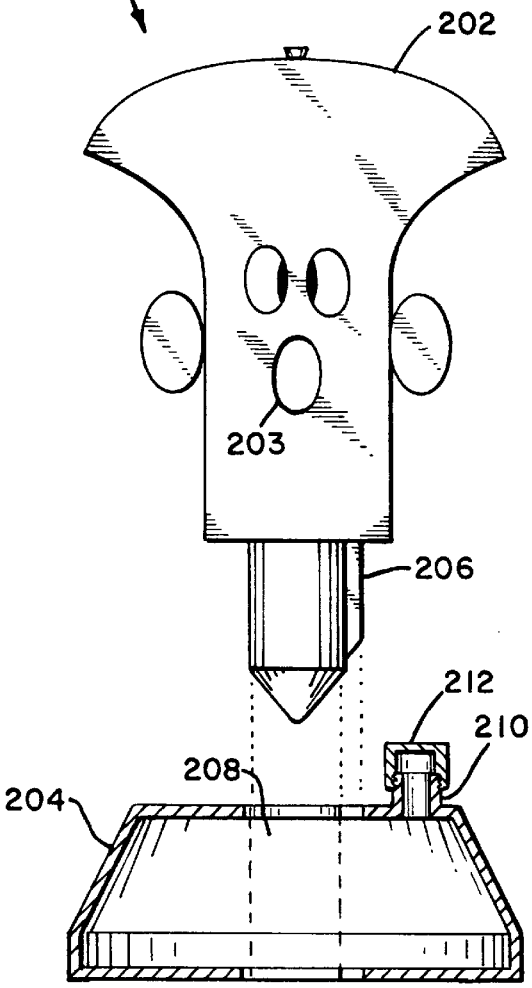
FIG. 13 is a front elevational view of the alternate embodiment of FIG. 12.

Referring to FIGS. 12 and 13, an alternate embodiment of the present invention is shown. Apparatus 200 generally comprises body 202, base 204 and elongate member 206 that is attached to the bottom of body 202. Body 202 includes opening 203 which functions in the same manner as opening 19 discussed above. Base 204 further comprises bore 208 for receiving elongate member 206. Base 204 is hollow and filled with water, sand, gravel, etc. so as to act as a weight. Base 204 further includes opening 210 for receiving fluid, sand, etc. and cap 212 adapted for covering opening 210. Apparatus 200 further comprises sunspot alignment region 214 located on base 204. Region 214 functions in the same manner as region 32 discussed above. Region 214 comprises stripes 216 and 218 of graphics material or indicia and function in the same manner as stripes 34 and 36 discussed above. Apparatus 200 is useful when soft soil or ground is not available but only relatively hard surfaces such as asphalt, cement, wood, etc. are available. In an alternate embodiment, base 204 is of solid construction and has sufficient weight to function as an anchor or weight to stabilize the apparatus of the present invention during use.

Figure 14:
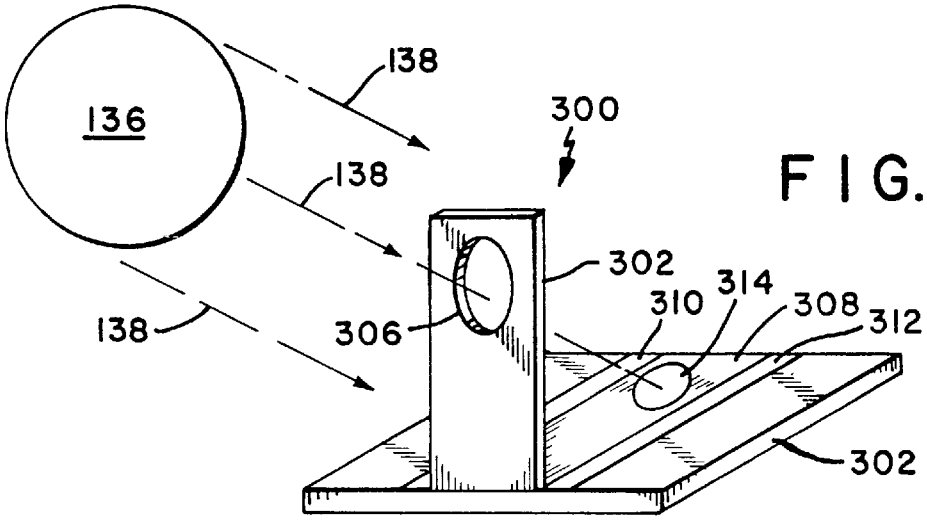

Referring to FIGS. 14–17 show alternate embodiments of the present invention. Each embodiment includes may include a fluid channel, fluid outlet, and fluid inlet as discussed above. However, the embodiments shown in FIGS. 14–17 may be configured without the fluid channel, fluid outlets and fluid inlets. Thus, the embodiments shown in FIGS. 14–17 may be used with other spray mist producing devices. Referring to FIG. 14, apparatus 300 comprises base 302, body 304 which attached to and generally vertically oriented with respect to base 302. Body has front side 305 and a rear side (not shown). Body includes opening 306 which functions in the same manner as opening 19 discusses above. Apparatus 300 includes sunspot alignment region 308. Region 308 comprises the portion of base 302 that is defined by stripes 310 and 312 of graphics material or indicia. Opening 306 allows the passage therethrough of rays 138 of sun 136 so as to create sunspot 314. Front side 305 is optimally aligned relative to sun 136 when it substantially directly faces the sun. The user will know when front face 305 substantially directly faces the sun when substantially all of sunspot 314 is located between stripes 310 and 312.

Figure 15:
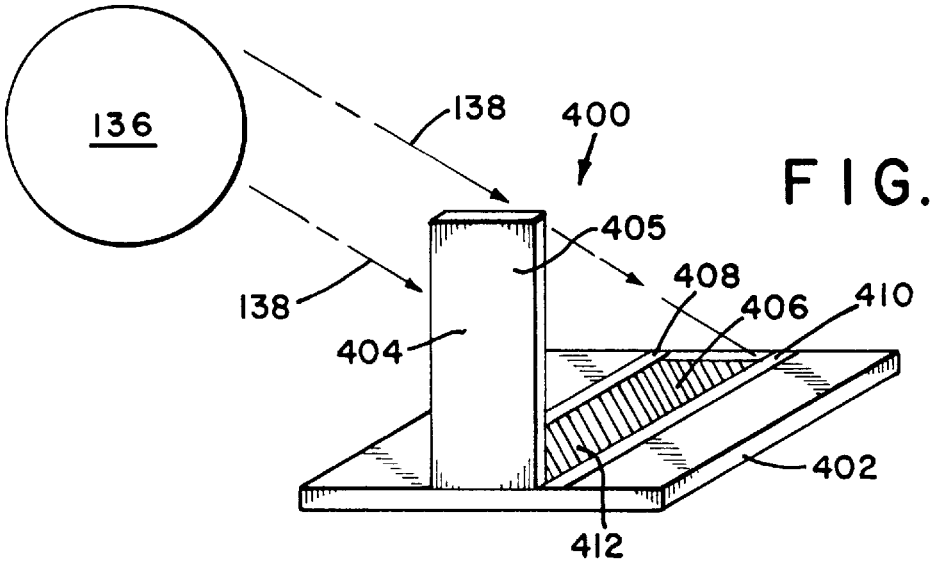

Referring to FIG. 15, apparatus 400 comprises base 402, body 404 which attached to and generally vertically oriented with respect to base 402. Body 404 has front side 405 and a rear side (not shown). Apparatus 400 includes shadow alignment region 406. Region 406 comprises the portion of base 402 that is defined by stripes 408 and 410 of graphics material or indicia. Body 404 obstructs rays 138 of sun 136 thereby creating shadow 412. Front side 405 is optimally aligned relative to sun 136 when front side 405 is substantially directly faces the sun. The user will know when front face 405 substantially directly faces the sun when substantially all of shadows 412 is located between stripes 408 and 410.

Figure 16:
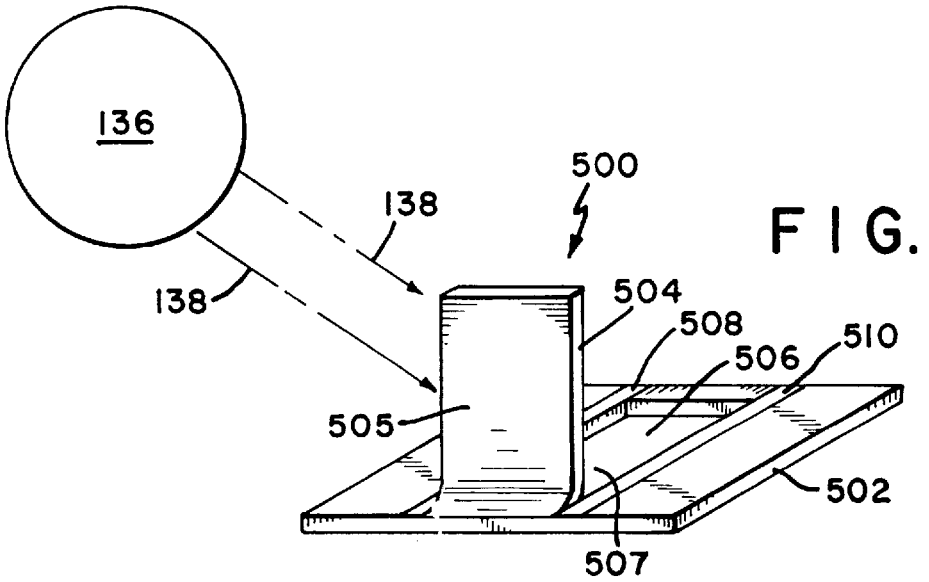

Referring to FIG. 16, apparatus 500 comprises base 502, body 504 which attached to and generally vertically oriented with respect to base 502. Body 504 has front side 505 and a rear side (not shown). Apparatus 500 includes shadow alignment region 506.

Region 506 comprises an opening 507 bordered stripes 508 and 510 of graphics material or indicia. Body 504 obstructs rays 138 of sun 136 thereby creating a shadow that appears within opening 507. Front side 505 is optimally aligned relative to sun 136 when front side 505 is substantially directly faces sun 136. The user will know when front face 505 substantially directly faces sun 136 when substantially all of the shadow created by body 504 is located on the area between stripes 508 and 510.

Figure 17:
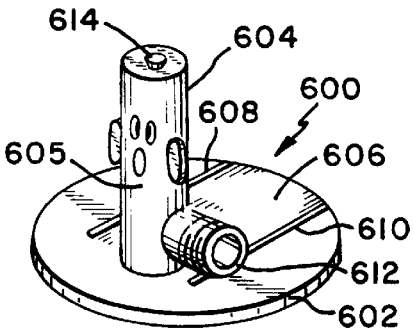
FIGS. 14–17 are perspective views of alternate embodiments of the apparatus of the present invention.

Referring to FIG. 17, apparatus 600 employs the concept of apparatuses 400 and 500 wherein the body obstructs the sunlight to create a shadow within the shadow alignment region. Apparatus 600 also includes a fluid channel and associated fluid outlets and inlets discussed above for apparatuses 10, 10', 10", and 100. Apparatus 600 comprises base 602, body 604 and shadow alignment region 606. Region 606 comprises the portion of base 602 between stripes 608 and 610 of graphic material or indicia. Body 604 obstructs rays 138 of sun 136 thereby creating a shadow that appears upon region 606. Front side 605 is optimally aligned relative to sun 136 when front side 605 is substantially directly faces sun 136. The user will know when front face 605 substantially directly faces sun 136 when substantially all of the shadow created by body 604 is located on the area between stripes 608 and 610. Apparatus 600 also includes fluid inlet 612 and fluid outlet 614.

Figure 18:
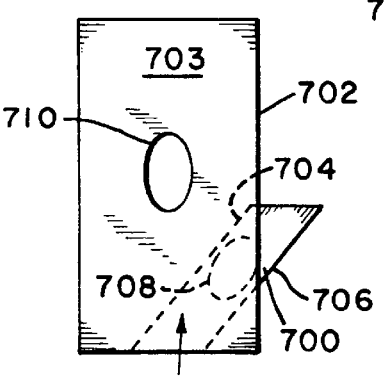
FIGS. 18 and 19 are perspective views illustrating the location of the sunspot alignment region relative to the rear side of the body of the apparatus of the present invention.
Figure 19:
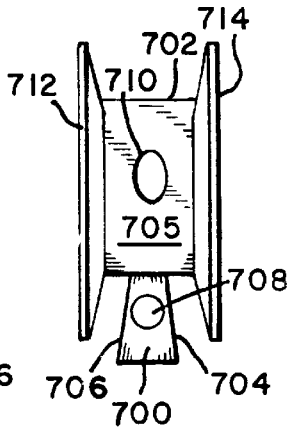

Referring to FIGS. 18 and 19, the ensuing discussion refers to sunspot alignment region 700 and body 702 which are used to represent the sunspot alignment regions and bodies discussed above. Body 702 comprises front side 703 and rear side 705. In every embodiment discussed above, each sunspot or shadow alignment region is located behind the body portion (i.e. adjacent to rear side 705 of the body) and comprises two parallel lines 704 and 706 which are separated by a distance substantially equal to the width of sunspot 708 created by sunlight passing through opening 710 (or the width of the shadow created by the body obstructing the sun light). In every embodiment, the sunspot or shadow alignment region falls between two parallel planes 712 and 714 that mark the sides of body 702 and which are perpendicular to the body 702. In every embodiment, the sunspot alignment region 700 (or the shadow alignment region) is equidistant from side to side from each plane 712 and 714. Sunspot alignment region 700 (or the shadow alignment region) may comprise a strip of hard or soft material that extends behind the body portion 702, i.e. extending away from rear side 705.

As discussed above, apparatuses 10, 10', 10", 100, 200, 300, 400, 500 and 600 may be fabricated from a variety of materials, e.g. plastic, wood, copper, brass, stainless steel, aluminum, PVC (polyvinylchloride), etc. In a preferred embodiment, apparatuses 10, 10', 10", 100, 200, 300, 400, 500 and 600 are fabricated from corrosion-resistant materials that can withstand relatively high fluid pressures.

OPERATION

The operation of rainbow producing apparatus of the present invention will now be discussed in detail and will provide the reader with a clear understanding of the function of the elements discussed above. Although the ensuing description discusses rainbow producing apparatus 10, the description is also applicable to rainbow producing apparatuses 10", 100, 200, 300, 400, 500 and 600.

Figure 11:
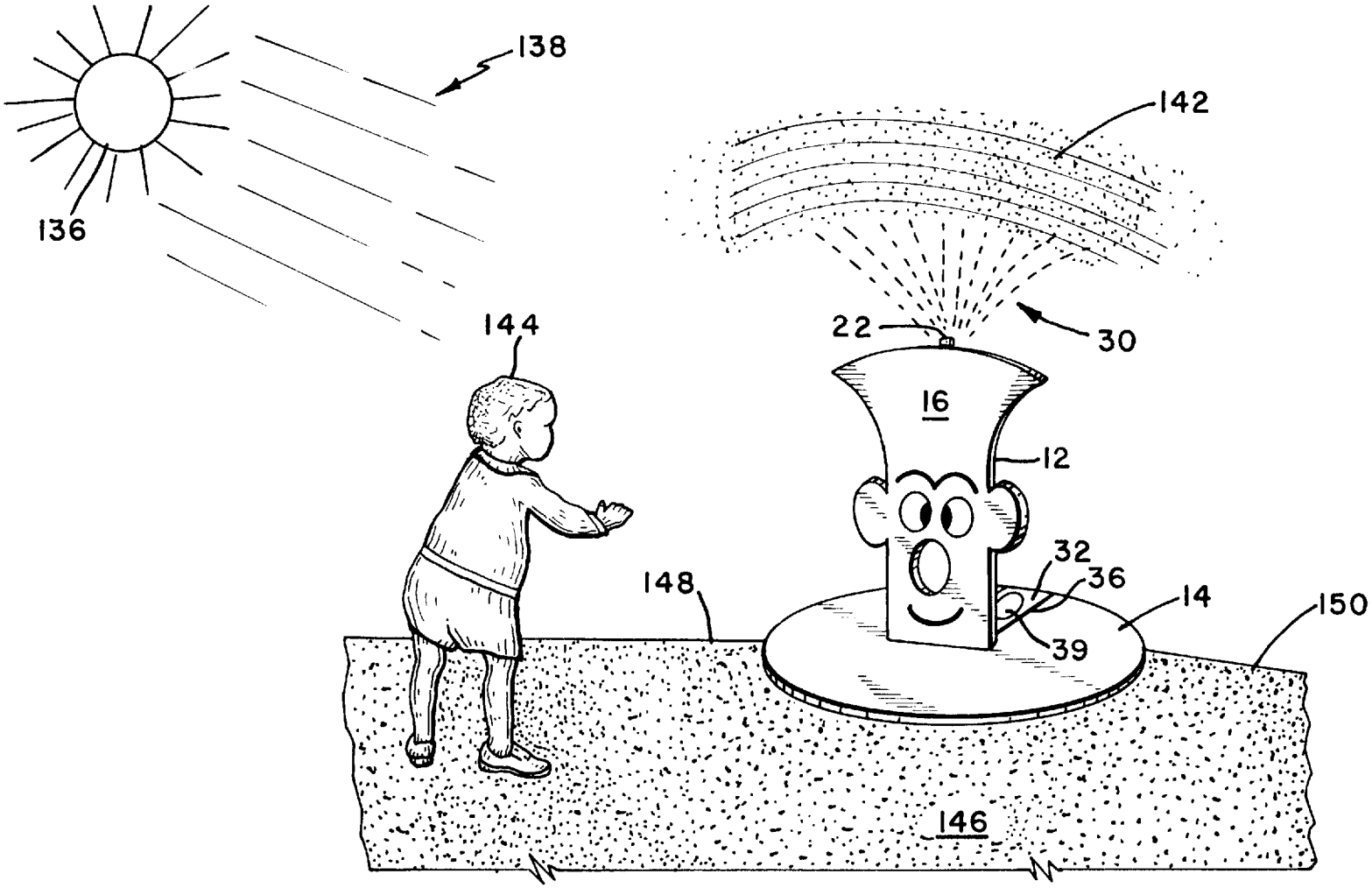
FIG. 11 illustrates the preferred positioning of a user relative to the rainbow producing apparatus of the present invention and the preferred positioning of the rainbow producing apparatus relative to the sun.

Referring to FIG. 11, the first step in effecting operation of the rainbow producing apparatus of the present invention is positioning apparatus 10 such that front side 16 of body 12 is facing the sun 136. If apparatus 10 has elongate member 40 attached thereto, then elongate member 40 is driven into the soil or ground. If apparatus 10 does not include elongate member 40, then the user need only set down apparatus 10 on the ground or soil such that base 14 rest upon the ground or soil (see FIG. 1A).

The next step is to adjust the position of apparatus 10 with respect to sun 136. Referring to FIGS. 2, 3, 4 and 11, the user rotates apparatus 10 so that that the rays 138 of sun 136 pass through opening 19 and create sunspot 39 in sunspot alignment region 32. This is accomplished by rotating apparatus 10 until sunspot 39 appears between stripes 34 and 36. If a colored or tinted transparent or translucent member is positioned within opening 19, then sunspot 39 will have a color that corresponds to the color of the transparent or translucent member. As discussed above, a colored or tinted transparent or translucent member facilitates identification of sunspot 39 and alignment of sunspot 39 between stripes 34 and 36. If apparatus 10" of FIG. 6 is used, then the user must rotate apparatus 10" until sunspot 39 appears between ends 37 and 38.

In a preferred embodiment, the fluid with which the apparatus of the present invention operates is water. Thus, the ensuing discussion describes the fluid as being water.

However, it is to be understood that the apparatus of the present invention can be used with other fluids. Next, the user connects a source of water to fluid inlet 21 of body 12 (see FIG. 1). This can be accomplished, for example, by the user connecting a standard flexible garden hose to fluid inlet 21.

Referring to FIG. 11, the next step is to allow water to flow through the fluid supply conduit so as to allow fluid outlet 22, i.e. nozzle 28 (see FIGS. 1 and 8) to emit mist 30.

The presence of mist 30 over apparatus 10 creates rainbow 142. In order to properly view rainbow 142, user 144 must be positioned such that user 144 is facing front side 16 of body 12 and sun 136 is at the back of user 144. As long as user 144 can see front side 16 1 5 of body 12, user 144 will be able to see rainbow 142. It is highly preferable that user 144 be positioned in viewing area 146 in order to view rainbow 142. Viewing area 146 is designated by the area between the lines designated by numerals 148 and 150. As discussed above, the front side 16 has indicia thereon which enables the user to identify which side of body portion 12 is front side 16.

Referring to FIG. 1A, if rainbow producing apparatus 10' is used, fluid conduit 20' may be configured as a single conduit, such as a standard garden hose, having fluid outlet 22' and being fluidly connected directly to a source of water. Such a configuration would not require fluid inlet 21'. In such a configuration, fluid outlet 22' would be configured as a nozzle 28 so as to produce mist 30.

Referring to FIG. 7, if rainbow apparatus 100 is used, mists 132*a*, 132*b*, and 132*c* are created thereby increasing the size of the rainbow. Such a rainbow starts at the general area of mist 132*a* , passes through the general area of mist 132*b* and ends at the general area of mist 132*c*. Thus, the rainbow produced by apparatus 100 is larger than the rainbow produced with apparatus 10.

The rainbow producing apparatus of the present invention may also be used for other purposes as well. For example, the apparatus may be used as a water toy wherein children may play in the sprays or mists created by the apparatus of the present invention.

The rainbow producing apparatus of the present invention may also be used for gardening, horticulture or landscaping purposes. Specifically, the apparatus of the present invention may be used for watering gardens and lawns. The fine, continuous spray or mists of water produced by the apparatus of the present invention are also suitable for watering seedlings and other sensitive plants typically found in greenhouses.

The present invention provides a rainbow producing apparatus that is:

a) safe to use for producing and viewing rainbows and playing in the spray or mist;

b) easy to set up and operate;

c) inexpensive to manufacture;

d) transportable;

e) decorative; and f) suitable for watering plants, lawns, gardens and seedlings.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An apparatus for producing and viewing rainbows comprising:

a body portion having a front side and a rear side;

a fluid source for producing a spray mist about the body portion; and means for optimally aligning the body portion relative to the sun, the body portion being optimally aligned when the front side of the body portion is substantially directly facing the sun;

the user of the apparatus being able to view a rainbow created as a result of the sunlight being refracted by the spray mist emanating from the fluid source when the user is facing the front side of the body portion and the sun is at the user's back.

2. The apparatus according to claim 1 wherein the body portion further comprises an elongate member extending substantially downward from the body portion, the elongate member having an end adapted for being driven into the ground to stabilize the body portion.

3. The apparatus according to claim 1 wherein the apparatus further comprises a base portion attached to the body portion for stabilizing the body portion.

4. The apparatus according to claim 3 wherein the fluid channel is supported by the base portion.

5. The apparatus according to claim 3 wherein the base portion is hollow and is adapted for containing a fluid so as to function as an anchor for stabilizing the base and body portions.

6. The apparatus according to claim 3 wherein the base and body portion are fabricated from corrosion-resistant materials.

7. The apparatus according to claim 1 wherein the apparatus further comprises a base portion attached to the body portion for stabilizing the body portion, the base portion further including an elongate member adapted for being driven into the ground to stabilize the base and body portion.

8. The apparatus according to claim 7 wherein the fluid channel further includes a plurality of fluid outlets for producing spray mists about the body portion.

9. The apparatus according to claim 1 wherein the fluid source further includes a fluid channel supported by the body portion.

10. The apparatus according to claim 9 wherein the fluid channel is generally vertically oriented and substantially extends for the entire height of the body portion.

11. The apparatus according to claim 9 wherein the fluid channel is integrally formed with the body portion.

12. The apparatus according to claim 9 wherein the fluid channel comprises a conduit attached to the rear side of the body portion.

13. The apparatus according to claim 9 wherein the front and rear sides of the body portion are separate pieces that are attached together, the fluid channel comprising a conduit disposed between the front and rear sides.

14. The apparatus according to claim 1 wherein the alignment means comprises:

an opening formed in the body portion for allowing the passage therethrough of sunlight;

a surface for receiving a sunspot created by sunlight passing through the opening in the body portion; and a region located on the surface and defined by an area generally between a pair of substantially parallel reference planes extending from the rear side of the body portion, the region indicating a desired position of the sunspot upon the surface.

15. The apparatus according to claim 14 further comprising a base portion attached to the body portion for stabilizing the body portion, the base portion having a generally horizontal top surface, the surface of the alignment means comprising a portion of the top surface of the base portion.

16. The apparatus according to claim 14 wherein the surface of the alignment means comprises an area of ground surface between the parallel planes.

17. The apparatus according to claim 14 wherein the alignment means further comprises indicia for indicating the region.

18. The apparatus according to claim 14 wherein the apparatus further includes a base portion that is attached to the body portion and which has a top surface, the surface of the alignment means comprising a portion of the top surface of the base portion.

19. The apparatus according to claim 14 wherein the alignment means comprises:

a surface for receiving a shadow cast by the body portion; and a region located upon the surface and defined by an area generally between a pair of substantially parallel reference planes extending from the rear side of the body portion, the region indicating a desired position of the shadow upon the surface.

20. The apparatus according to claim 1 further comprising indicia located on the front side of the body portion.

21. The apparatus according to claim 14 further comprising a transparent member positioned within the opening of the body portion.

22. The apparatus according to claim 21 wherein for the transparent member is colored.

23. A method for producing and viewing a rainbow comprising the steps of:

(a) providing an apparatus comprising (i) a body portion having a front side and a rear side, (ii) a fluid source for producing a spray mist about the body portion, and (iii) means for optimally aligning the body portion relative to the sun, the body portion being optimally aligned when the front side of the body portion is substantially directly facing the sun;

(b) stabilizing the body portion so as to substantially eliminate movement of the body portion during use of the apparatus;

(c) aligning the body portion to an optimal position relative to the sun;

(d) causing a spray mist to emanate from the fluid source; and (e) viewing a rainbow formed around the apparatus by positioning oneself in a manner such that one is able to view the front side of the body portion and the sun is at one's back.

24. The method according to claim 23 wherein in aligning step (c), the apparatus is optimally aligned when the front side of the body portion is substantially directly facing the sun.

25. The method according to claim wherein the apparatus further comprises an elongate member extending substantially downward from the body portion, the elongate member adapted for being driven into the ground to stabilize the body portion, the stabilizing step (b) further comprising the step of driving the elongate member into the ground.

26.The method according to claim 25 wherein the elongate member has a substantially circular cross-section to facilitate aligning step (c).

27. The method according to claim 23 wherein the causing step (d) includes the step of fluidly connecting the fluid channel to a source of fluid.

* * * * *

UNITED STATES PATENT AND TRADEMARK OFFICE
CERTIFICATE OF CORRECTION

PATENT NO : 5,842,925

DATED : December 1, 1998

INVENTOR(S): Mary Doherty Ellroy & Frank A. Posluszny

It is certified that error appears in the above-identified patent and that said Letters Patent is hereby corrected as shown below:

In Column 4, line 18, please delete "21 a" and substitute therefor --21a--.

In Column 6, line 62, please delete "104" and substitute therefor --102--.

In Column 9, line 36, please delete "15".

In Column 10, claim 4, please delete "3" and substitute therefor --9--.

Signed and Sealed this

Second Day of November, 1999

*Attest:*

Q. TODD DICKINSON

*Attesting Officer*

*Acting Commissioner of Patents and Trademarks*